US005079391A

United States Patent [19]

Koyanagi et al.

[11] Patent Number: 5,079,391

[45] Date of Patent: Jan. 7, 1992

[54] PUFFER TYPE GAS CIRCUIT BREAKER, CONTACT COVER AND INSULATED NOZZLE OF THE BREAKER

[75] Inventors: Osamu Koyanagi; Masanori Tsukushi; Yasuharu Seki; Yukio Kurosawa, all of Hitachi, Japan

[73] Assignee: Hitachi, Ltd., Tokyo, Japan

[21] Appl. No.: 604,227

[22] Filed: Oct. 29, 1990

[30] Foreign Application Priority Data

Nov. 11, 1989 [JP] Japan ..... 1-293419

[51] Int. Cl.[5] ..... H01H 33/82

[52] U.S. Cl. ..... 200/148 A; 200/148 R

[58] Field of Search ..... 200/148 R, 148 A, 148 B

[56] References Cited

PUBLICATIONS

Japanese Utility Model Unexamined Publication No. 59-187043.

*Primary Examiner*—Harold Broome

*Attorney, Agent, or Firm*—Antonelli, Terry, Stout & Kraus

[57] ABSTRACT

A puffer type gas circuit breaker having at least one pair of a stationary contact and a movable contact capable of being separated from each other, a pressure producing section including a puffer cylinder and a puffer piston. The puffer cylinder is connected to the movable contact and serves to compress an arc extinguishing gas blown to an arc generated between the contacts at the time of current breaking. The breaker also has a cover surrounding the movable contact, an insulated nozzle extending from the puffer cylinder and surrounding the cover and the stationary contact to form a flow passage through which the compressed gas is supplied from the puffer cylinder to the generated arc, and a flow straightening member provided in said flow passage. The flow straightening member extends from the puffer cylinder and is mounted on the cover, and the flow passage has an expanded section having a gas flow sectional area larger than that of the section of the flow passage upstream of the expanded section.

12 Claims, 11 Drawing Sheets

PUFFER TYPE GAS CIRCUIT BREAKER, CONTACT COVER AND INSULATED NOZZLE OF THE BREAKER

BACKGROUND OF THE INVENTION

This invention relates generally to puffer type gas circuit breakers and, more particularly, to a puffer type gas circuit breaker having an improved breaking structure and to a contact cover and an insulated nozzle of this breaker.

Ordinarily, in a puffer type gas circuit breaker, arc extinguishing gas in a puffer chamber which is highly compressed and not heated excessively is blown to an arc generated between separated contacts to extinguish the arc in a linked relationship with the operation of disconnecting the contacts. For this operation, it is necessary that the arc extinguishing gas is suitably pressurized and is efficiently blown to the arc.

Japanese Patent Examined Publication No. 52-21701 and Japanese Utility Model Unexamined Publication No. 59-187043 disclose breakers of this kind. FIGS. 12 and 13 show breaking sections of these breakers.

In the breaker shown in FIG. 12, a flow straightening member 89 is provided in a gas flow passage section of an insulated nozzle 87.

FIG. 14 shows the change in the sectional area of the gas flow passage in the insulated nozzle 87 of this breaker in the gas flowing direction, and FIG. 15 shows the change in pressure in the gas flowing direction.

In FIGS. 14 and 15, the abscissas indicate positions a to e shown in FIG. 12, the ordinate of FIG. 14 represents gas flow passage sectional area S and the ordinate of FIG. 15 represents pressure P.

Referring to FIG. 14, the change in the sectional area in the case where the flow straightening member 89 is provided is as represented by a characteristic curve shown as broken line A, and the change in the sectional area in the case where the flow straightening member 89 is not provided is as represented by a characteristic curve shown as solid line B. Referring to FIG. 15, the change in the pressure in the insulated nozzle in the case where the flow straightening member 89 is provided is as represented by a characteristic curve C, and the change in the pressure in the insulated nozzle in the case where the flow straightening member 89 is not provided is as represented by a characteristic curve D.

Also, according to IEEE Transactions of power Apparatus and Systems, Vol. PAS-98, No. 3 May/June 1979 (p. 731 to 737), a temperature of the gas E in the insulated nozzle of the conventional gas breaker shown in FIG. 12 is excessively higher than a suitable gas temperature F since a volume in the insulated nozzle is decreased by the straightening member mounted therein, resulting in failure to set a suitable gas temperature as shown in FIG. 16. The same can also be said with respect to the insulated nozzle shown in FIG. 13. An extinguishing gas-pressure in a puffer-chamber is increased by heating with arc energy occurring in the chamber FIG. 13.

SUMMARY OF THE INVENTION

It is an object of the present invention to provide a puffer type gas circuit breaker having an improved arc extinguishing performance and, hence, an improved current breaking performance.

It is another object of the present invention to provide a contact cover of a puffer type gas circuit breaker relating to an improvement in the flow passage for the compressed arc extinguishing gas.

It is still another object of the present invention to provide an insulated nozzle of a puffer type gas circuit breaker relating to an improvement in the flow passage for the compressed arc extinguishing gas.

According to the present invention, there is provided a puffer type gas circuit breaker comprising: at least one pair of a stationary contact and a movable contact capable of being separated from each other; a pressure producing section having a puffer cylinder and a puffer piston, the puffer cylinder being connected to the movable contact and the cylinder and the piston being capable of compressing an arc extinguishing gas blown to an arc generated between the contacts at the time of current breaking; a cover surrounding the movable contact; an insulated nozzle extending from the puffer cylinder and surrounding the cover and the stationary contact to form a flow passage through which the compressed gas is supplied from the puffer cylinder to the generated arc; and a flow straightening member provided in the flow passage. The flow straightening member is extended from the puffer cylinder and is mounted on the cover, and the flow passage has an expanded section having a gas flow sectional area larger than that of the section of the flow passage upstream of the expanded section.

According to the present invention, there is also provided a cover for covering a contact of a puffer type gas breaker having a puffer cylinder and a puffer piston, the cover comprising: a cylindrical main body; and a plurality of flow straightening members corresponding to a plurality of gas supply hole formed in the cylinder. The flow straightening members are positioned between the neighboring gas supply holes and extend are extended in the axial direction the main body along outside surfaces of thereof. A chamber having a sectional area larger than the sectional area of the space in the radial direction between the cover and the insulated nozzle is formed between the insulated nozzle and an end of the cover on the side of the insulated nozzle when the insulated nozzle is attached so as to surround the cover.

According to the present invention, there is further provided an insulated nozzle for a puffer type gas circuit breaker comprising: a first insertion hole into which a movable contact can be inserted, the first insertion hole extending from one end of a nozzle body generally along the center axis thereof; a plurality of flow passages formed in the nozzle body so as to respectively communicate with a plurality of gas supply holes formed in a puffer cylinder and to extend generally in the axial direction from the end away from the insertion hole; and an expanded chamber formed in the nozzle body having a sectional area larger than that of the upstream flow passages. The flow passages communicate with the expanded chamber at their ends, the first insertion hole includes a central aperture, and a second insertion hole through which a stationary contact is inserted is formed at the other end of the nozzle body.

DESCRIPTION OF THE PREFERRED EMBODIMENTS

Embodiments of the present invention will be described below with reference to the accompanying drawings.

Figure 1:
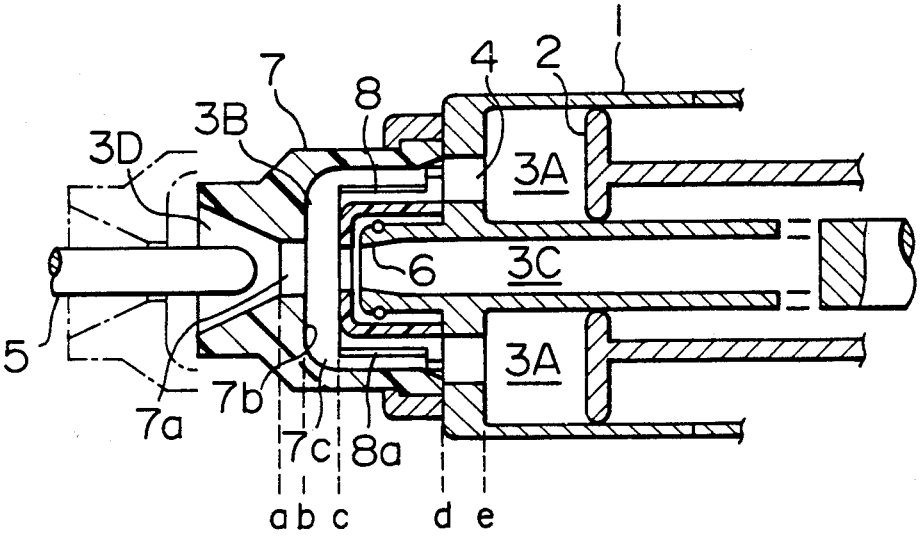
FIG. 1 is a cross-sectional view of a puffer type gas circuit breaker in accordance with an embodiment of the present invention.

FIG. 1 is a longitudinal cross-sectional view of a puffer type gas breaker in accordance with an embodiment of the present invention in a middle stage of breaking operation. This breaker has a puffer cylinder 1 capable of slidably moving relative to a stationary piston 2. The puffer cylinder 1 is fitted around the piston 2 to form a puffer chamber 3A. A movable contact 6 is provided on an end portion of the puffer cylinder 1 at the center thereof. An opening is formed at an end of the movable contact 6. A stationary contact 5 can be inserted into this opening while establishing steady contact with the movable contact 6. A dot-dash line in FIG. 1 indicates the position of the insulated nozzle 7 when these contacts become in contact with each other. As the movable contact 6 is detached, i.e., is moved away from the stationary contact 5, an arc extinguishing gas in the puffer chamber 3A is compressed. The compressed gas is jetted through a plurality of gas supply holes 4 formed in the puffer cylinder 1. The gas is thereafter led to the space between the two contacts through a flow passage 3B formed by an insulated nozzle 7 attached to the puffer cylinder 1, a cover 8 surrounding the movable contact 6 and formed of an insulating material, and flow straightening members 8*a* provided on the cover 8. A curved surface end 7*b* of the flow passage 3B is defined on the inner surface of the insulated nozzle 7 upstream of a throat 7*a* of this nozzle in the direction of the blowing gas flow. The curved surface end 7*b* is formed between positions b and c and the throat 7*a* is formed between positions a and b, as viewed transversely in FIG. 1.

In this embodiment, one end of the generally cylindrical cover 8 is fixed to the puffer cylinder 1 while the other end extends to the position c upstream of the curved surface end 7*b* in the direction of the blowing gas flow. Details of the cover 8 are as described below with reference to the enlarged perspective view of FIG. 2. As illustrated, the flow straightening members 8*a* are integrally formed on the cover 8 on the outer peripheral side thereof so as to be positioned between the plurality of gas supply holes 4 at the end surface of the puffer cylinder 1. The flow straightening members 8*a* extend in radial directions to the inner peripheral surface of the insulated nozzle 7 and also extend in the longitudinal direction of the puffer cylinder 1.

Consequently, at the time of breaking operation, the blowing gas jetted through the gas supply holes 4 flows through the sections of the gas flow passage 3B formed along the adjacent pairs of flow straightening members 8*a* and extending from the gas supply holes 4. The blowing gas is thereafter discharged mainly through the throat 7*a* of the insulated nozzle 7.

Figure 12:
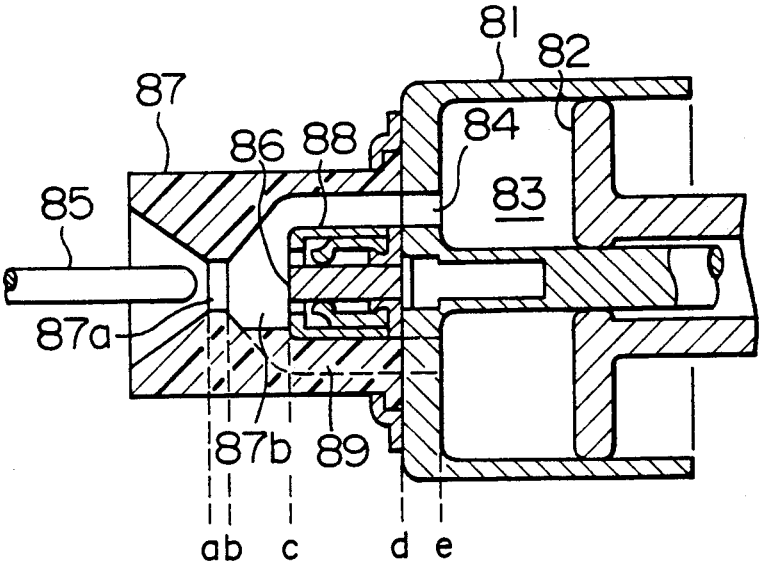
FIG. 12 PRIOR ART
FIGS. 12 and 13 are cross-sectional views of conventional puffer type gas breakers.

The gas flow passage thus formed between the insulated nozzle 7 and the cover 8 differs from that of the conventional breaker shown in FIG. 12 in that the flow straightening members 8*a* of the present invention are ended on the stationary contact 5 side upstream of the curved surface end 7*c* of the insulated nozzle 7 in the direction of the blowing gas flow. The gas flow passage of the present invention also differs from that of the conventional breaker shown in FIG. 13 in that while the sectional area of the flow passage is gradually reduced in the blowing gas flow direction in the arrangement of FIG. 13, a section 7*c* at which the sectional area is abruptly increased is formed at the blowing gas downstream end of the cover 8 in the embodiment of the present invention. This differences will be described below in more detail with specific reference to FIG. 3.

Figure 3:
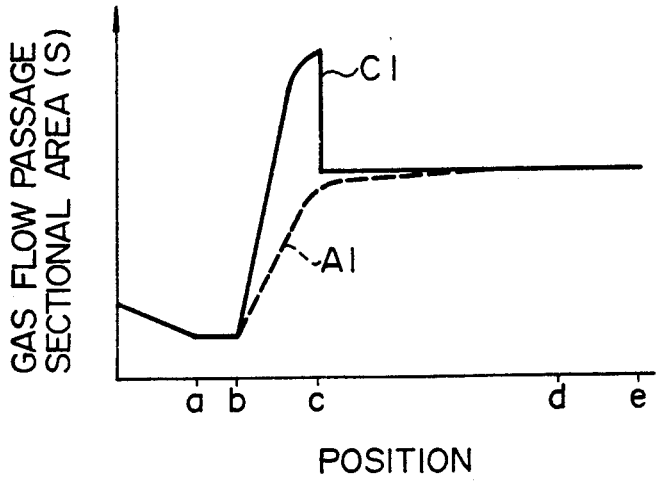
FIGS. 3, 4, and 5 are diagrams of comparison between the characteristics of the breaker of the present invention and the conventional breakers in terms of gas flow passage sectional area, pressure and gas temperature respectively.
Figure 4:
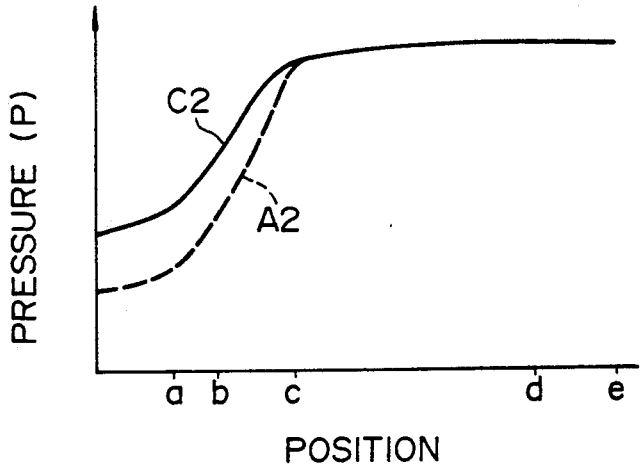
Figure 5:
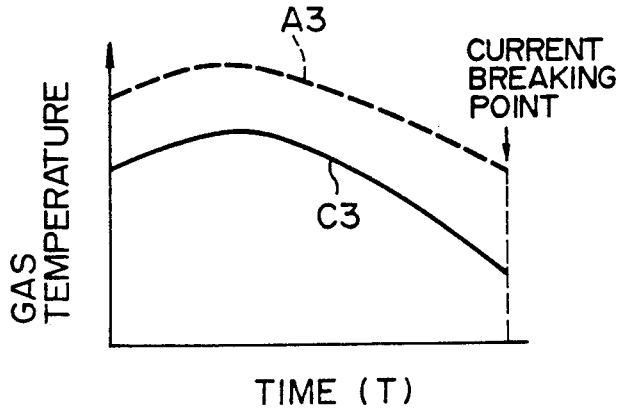
Figure 13:
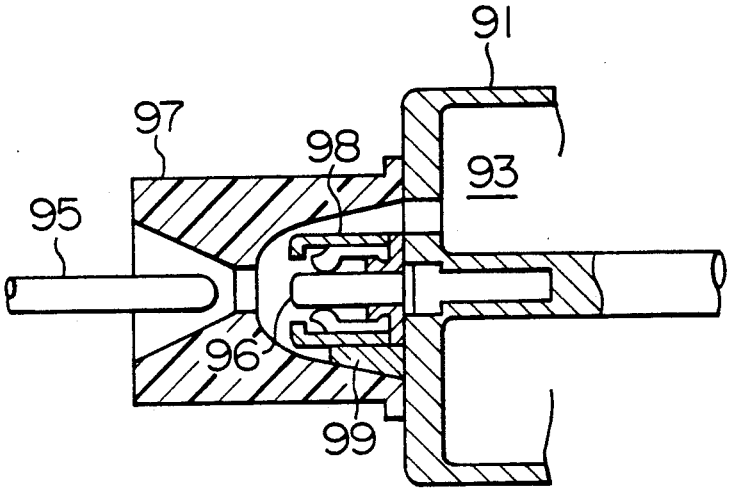
FIG. 13 PRIOR ART
Figure 14:
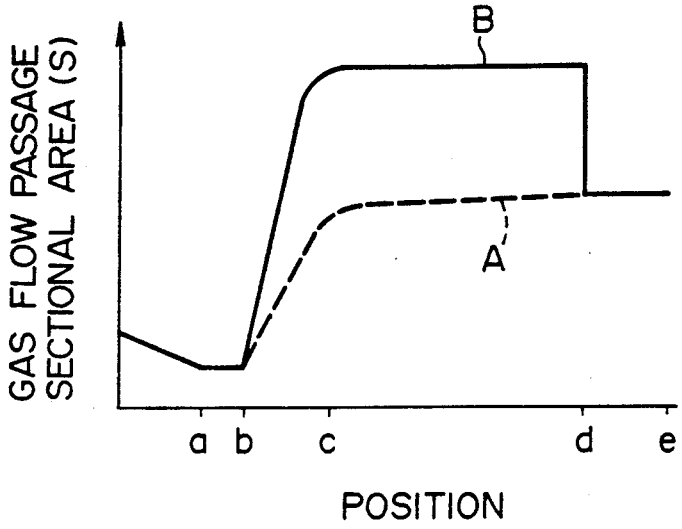
FIGS. 14, 15, and 16 are diagrams of the characteristics of the conventional breakers in terms of gas flow passage sectional area, pressure and, gas temperature and breaking current, respectively.
Figure 15:
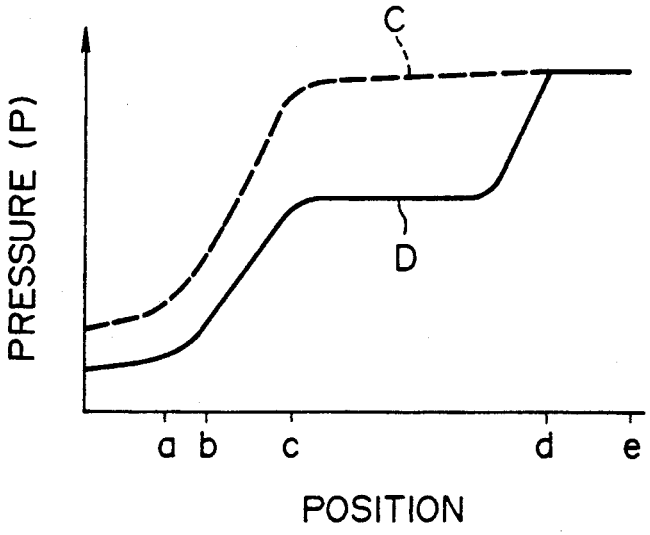
Figure 16:
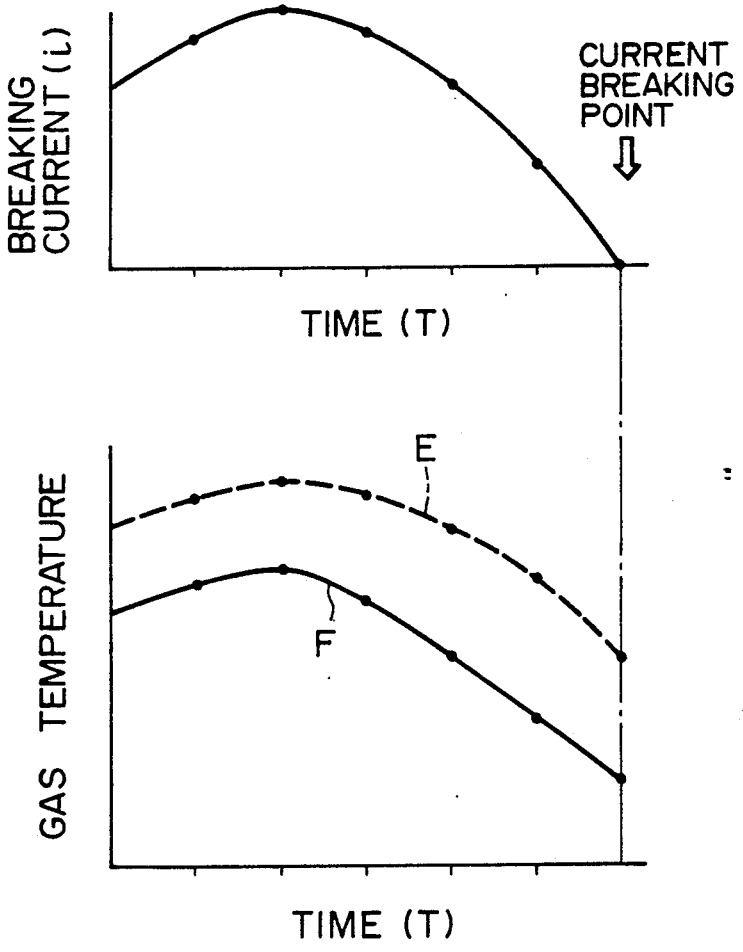

Curve A1 shown in FIG. 3 represents a characteristic of the change in the sectional area of the gas flow passage formed between the insulated nozzle 87 and the cover 89 of the conventional breaker and between the insulated nozzle 97 and the cover 98 of the breaker respectively shown in FIGS. 12 and 13 with respect to positions in the gas flowing direction, and curve C1 represents a characteristic of the change in the sectional area of the gas flow passage formed between the insulated nozzle 7 and the cover 8 of the embodiment shown in FIG. 1 with respect to positions in the gas flowing direction. The positions indicated on the abscissa correspond to the positions shown in FIG. 1. As can be understood from comparison between the curves A1 and C1, the changes in the sectional areas of the two gas flow passages are generally equal from the position e of the gas supply hole 4 of the puffer cylinder 1 to the position c of the downstream end of the cover 8, but they greatly differ from each other from the position c of the downstream end of the cover to the position b of the curved surface end 7*a*. That is, the flow passage sectional area represented by curve C1 is abruptly increased relative to that represented by curve A1 at the position c. Accordingly, in the breaker of the present invention, the arc extinguishing gas compressed in the puffer chamber 3 is led to the vicinity of the position c corresponding to the upstream side of the curved surface end 7*b* while preventing any abrupt increase in the flow passage sectional area S by the flow straightening members 8*a* when it is introduced from the position d of the gas supply holes into the flow passage. The gas is also guided by the flow straightening members 8*a* so as to flow straight. Occurrence of turbulence in the flowing is thereby prevented. Also, the pressure loss in the vicinity of the curved surface end 7*b* is reduced by an improvement of the flow passage performance as a result of an increase of the area of flow passage between a position b to a position c. It is thereby possible to limit the reduction in the blowing gas pressure, as indicated by pressure curve C2 in FIG. 4, in comparison with the pressure characteristic of the conventional breaker represented by curve A2. The expanded section 7*c* is formed in the vicinity of the curved surface end 7*b* so that the capacity in the vicinity of the arc generation section is increased, thereby preventing any excessive increase in the temperature of the gas due to the gas blowing pressure at this position, as indicated by temperature curve C3 of FIG. 5, in comparison with characteristic of the conventional breaker indicated by temperature curve A3. The corresponding improvement in the temperature characteristics is as represented by a characteristic, such as that shown in FIG. 5, of the temperature at the curved surface end 7*b* of a flow passage in which no flow straightening member is provided. In FIG. 16, curve F corresponds to the gas temperature characteristic of the present invention, and curve E corresponds to the gas temperature characteristic of the conventional breaker. That is, the blowing gas flowing into the flow passage from the puffer chamber 3 expands in an adiabatic manner in the vicinity of the curved surface end 7*b*, so that the gas temperature is suitably reduced when the gas is applied to the arc at the zero breaking current time, thereby improving the breaking performance.

Further, the improvement of the flow passage performance can curve a transfer of the arc energy produced between the two contacts when the arc is generated smooth and then a suitably high pressure occurs in the puffer chamber. The breaker of the present invention can therefore maintain improved breaking performance even if the breaking operation is continuously repeated.

Figure 6A:
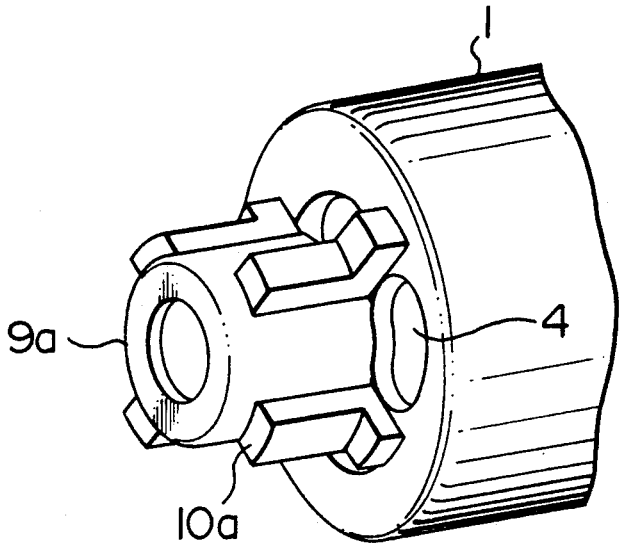
FIGS. 6A, 6B and 6C are perspective views of puffer cylinder and cover of other embodiments of the present invention.
Figure 6B:
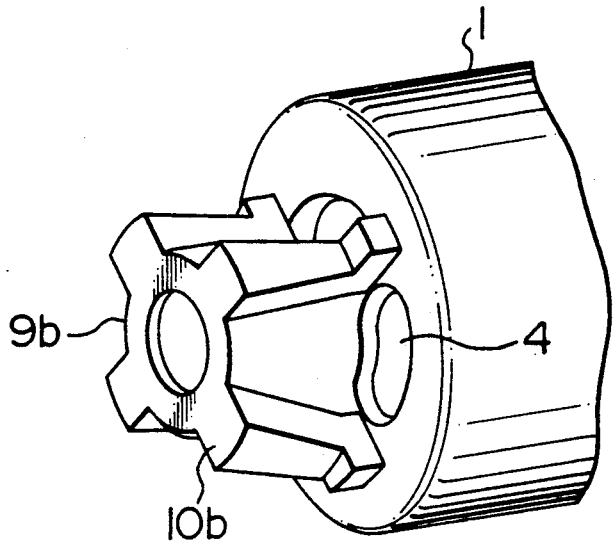
Figure 6C:
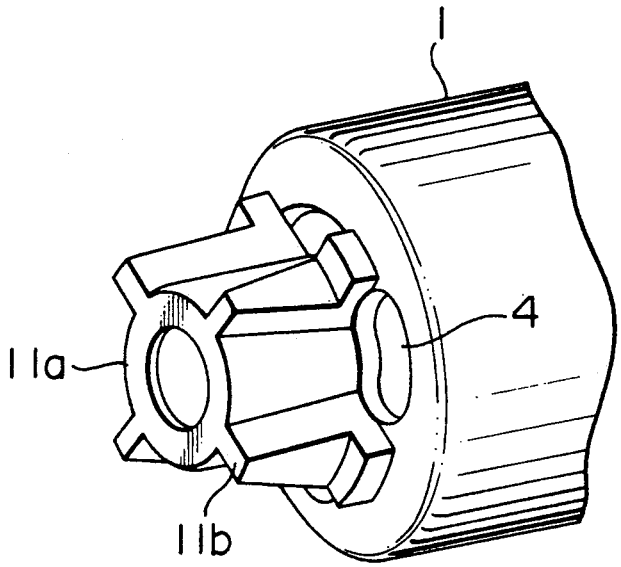

FIGS. 6A, 6B and 6C are expanded perspective views of embodiments of the invention, which show the covers 9*a*, 9*b* and 11*a* with the corresponding flow straightening members 10*a*, 10*b* and 11*b* having different shapes from one another. Also, FIG. 6D is a diagram of characteristics of change in sectional area of the gas flow passage in the embodiments shown in FIGS. 6A, 6B and 6C.

Figure 6D:
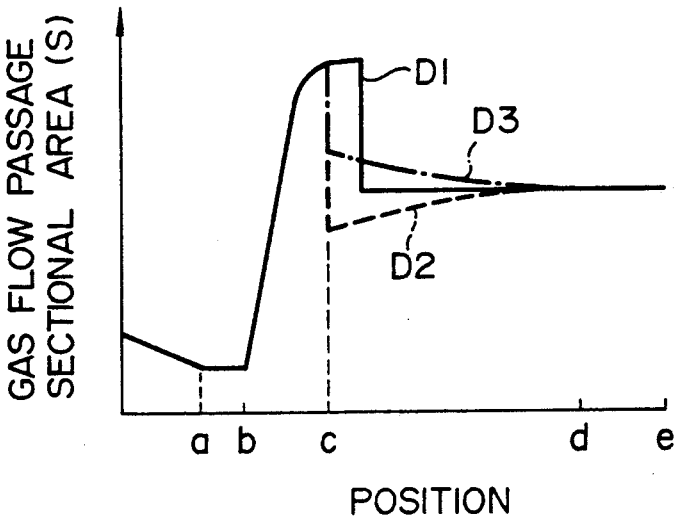
FIG. 6D is a diagram of comparison between the characteristics of the breaker of the present invention in use of covers shown in FIGS. 6A, 6B and 6C.

The straightening member 10*a* of the embodiment shown in FIG. 6A extends from an edge-surface of the puffer cylinder 1 to a substantially middle position between positions c and d, and the characteristics of change in sectional area are denoted by D1 which is shown in FIG. 6D.

The straightening members 10*b* and 11*b* of the embodiments shown in FIGS. 6B and 6C have tapered shapes as extended in a direction to the cylinder 1 and to an edge of the cover 9*d*, respectively. The characteristics of change in sectional area in the members 10*b* and 11*b* are denoted by D2 and D3, respectively, which are shown in FIG. 6D.

Figure 2:
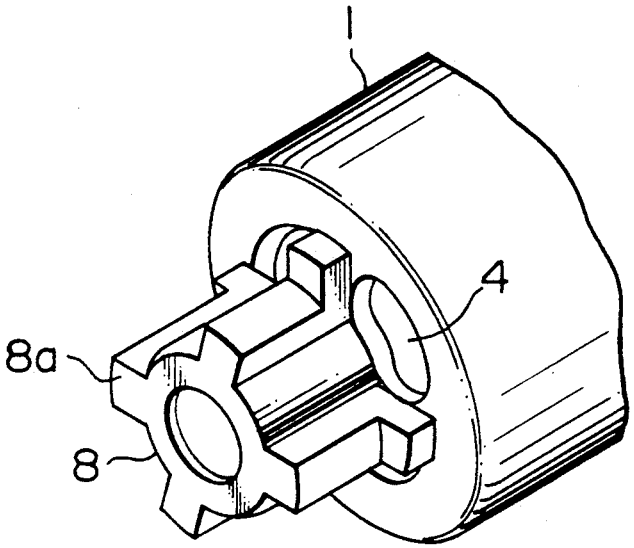
FIG. 2 is a perspective view of the appearance of a puffer cylinder and a cover of the present invention.

Thus, the flow straightening members which are shaped so as to provide expanded portions of the gas flow area in the vicinity of the position between b and c can obtain the same effect as in the embodiment shown in FIG. 2.

Figure 7A:
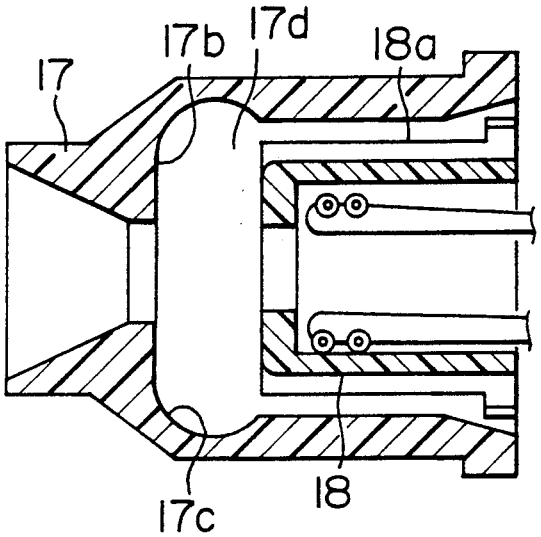
FIGS. 7A and 7B are cross-sectional views of other embodiments of the present invention.
Figure 7B:
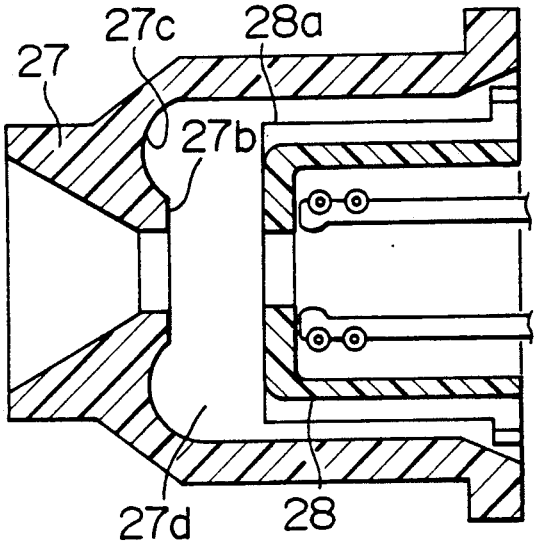

FIGS. 7A and 7B show sectional main portions of puffer type gas breakers in accordance with other different embodiments of the present invention. These embodiments differ from the first embodiment because they have a construction whereby the expanded section in which the flow passage sectional area is increased is formed upstream of the curved surface end 7*b* of the gas flow passage in the direction of the blowing gas flow. That is, in the first embodiment, the blowing gas downstream end of the cover 8 or the flow straightening member 8*a* is limited to form the expanded section. In the embodiment shown in FIG. 7A, an annular recess 17*c* is formed in an insulated nozzle 17 in the vicinity of a curved surface end 17*b* by being recessed in the radial direction, and the expanded section 17*d* in which the flow passage sectional area is increased is obtained by virtue of the above-described construction and the annular recess 17*c*. In the embodiment shown in FIG. 7B, an annular recess 27*c* is formed in an insulated nozzle 27 in the vicinity of a curved surface end 27*b* by being recessed in the longitudinal direction, and the expanded section 27*c* in which the flow passage sectional area is increased is obtained by virtue of the above-described construction and the annular recess 27*c*. According to these embodiments, therefore, the same effects as those of the first embodiment can be obtained. Also, the sectional area of the flow passage in the expanded section can be easily increased relative to the flow passage sectional area in the section upstream of the expanded section in the direction of the blowing gas flow.

Figure 8:
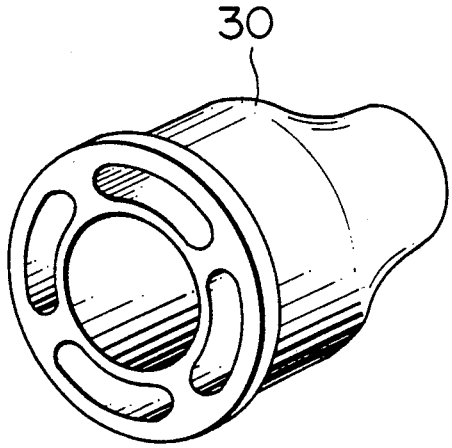
FIG. 8 is a perspective view of an example of the insulation nozzle of the present invention.

Each of the above-described embodiments represents an arrangement in which the gas flow passage is formed between the insulated nozzle 7 and the cover 8. However, the insulated nozzle and the cover may be integrally formed as a molded tube 30, as shown in FIG. 8.

In the arrangement shown in FIG. 1, there is the risk of an electroconductive material, e.g., carbon being separated by exposure to the arc and entering the gaps between the inner surface of the insulated nozzle 7 and the outer surfaces of the cover 8 to stay therein. That is, the accumulation of such an electroconductive material influences the electric field at the extreme end of the movable contact 6 so that the interpole withstand voltage is reduced, or reduces the creepage insulation performance on the inner surface of the insulated nozzle 7. However, if a molded tube 30 in which the cover and the insulated nozzle are integrally formed as shown in FIG. 8 is used, the possibility of the above-mentioned entrance of an electroconductive material is eliminated and there is no risk of a reduction in the interpole withstand voltage or the creepage insulation performance.

Figure 9A:
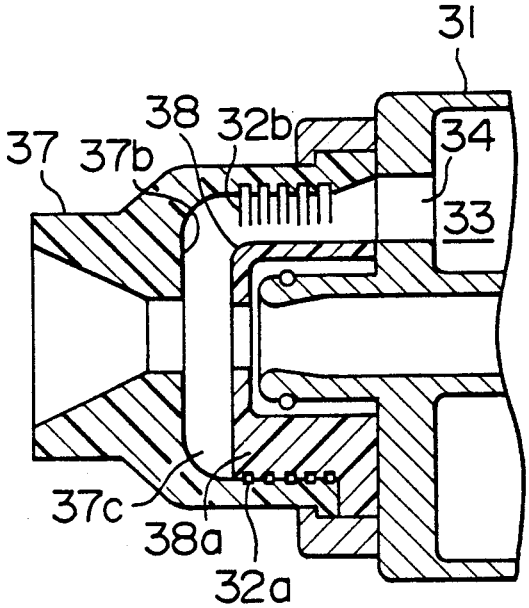
FIGS. 9A, 9B, and 9C are cross-sectional views of puffer type gas circuit breakers in accordance with a still further embodiments of the present invention.
Figure 9B:
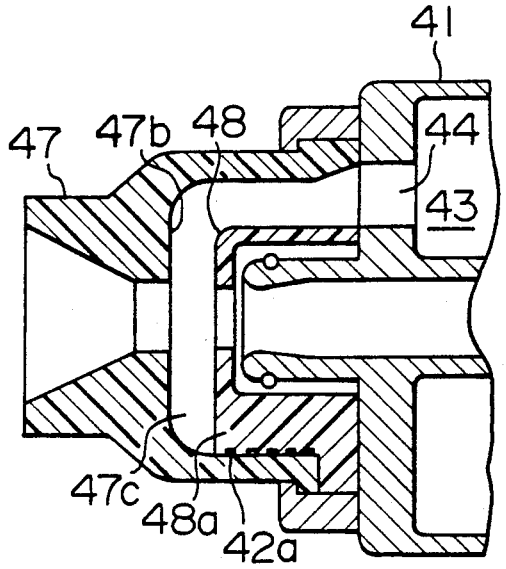
Figure 9C:
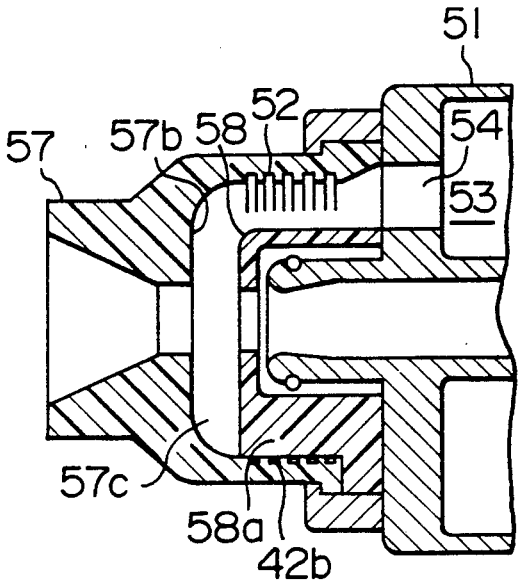

Reduction in the interpole withstand voltage can also be prevented by arrangements such as those shown in FIGS. 9A, 9B, and 9C. That is, a plurality of annular grooves 32*a*, 32*b*, 42, or 52 each extending in the peripheral direction are formed in inner surfaces of at least one of the insulated nozzle 37, 47, or 57 and the flow straightening members 38*a*, 48*a*, or 58*a* of the cover 38, 48, or 58 to equivalently increase the creeping distance along the inner surface of the insulated nozzle. Reduction in the creepage insulation performance is thereby prevented even if an electroconductive material enters the gaps.

Figure 10:
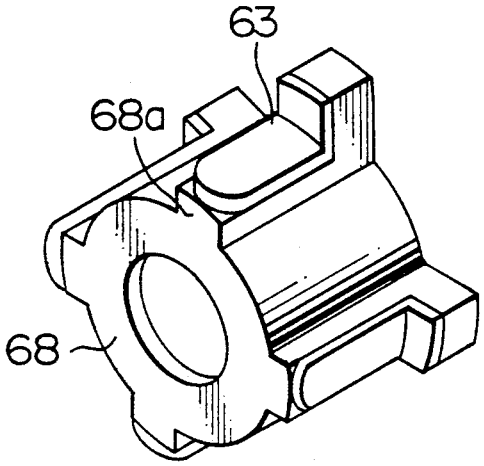
FIG. 10 is a perspective view of the appearance of the cover of a puffer type gas circuit breaker in accordance with a still further embodiment of the present invention.

Referring to FIG. 10, four flow straightening members 68*a* are integrally formed on a cover 68, and an electroconductive shield 63 is disposed on the surface of each flow straightening member 68*a* opposed to the insulated nozzle. According to this arrangement, even if the above-mentioned electroconductive material enters the gaps on the opposed portions, there is no possibility of influence upon the electric field at the extreme end of the movable contact 6 because the potential of the opposed portions is determined by the electroconductive shields 63. An annular electroconductive shield continuous in the circumferential direction between the insulated nozzle and the cover may be provided instead of the four electroconductive shields 63 separated in the circumferential direction. The cover may be formed of a member having improved resistance to the arc in a similar arrangement to obtain the same effects.

Figure 11A:
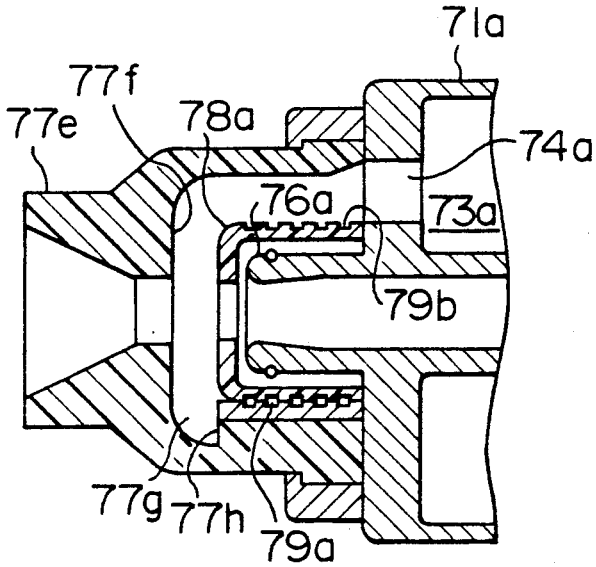
FIGS. 11A and 11B as cross-sectional views of a puffer type gas circuit breaker in accordance with still further embodiments of the present invention.
Figure 11B:
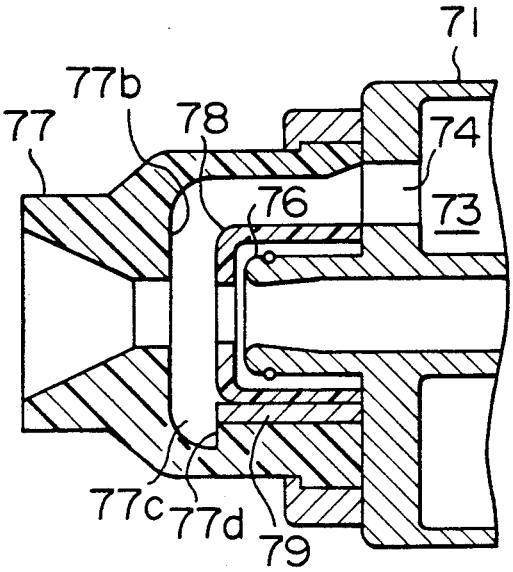

FIGS. 11A and 11B show in section main portions of a puffer type gas breaker in accordance with a further embodiment of the present invention. This embodiment will be described below with respect to the difference from the other embodiments.

In the embodiment shown in FIG. 11B, there is included a cylindrical cover 78, and flow straigthening members **77*d* integrally formed on the inner surface of an insulated nozzle 77 which surrounds the cover 78 while being spaced apart from the same. The flow straightening members 77*d* are disposed so that a plurality of gas supply holes 74 formed in a puffer cylinder 71 are located between the upstream ends of the flow straightening members 77*d*. The downstream ends of the flow straightening members 77*d* generally coincide with the downstream ends of the cover 78. Accordingly, an expanded section 77*c* having a flow passage sectional area larger than that of the upstream section can be formed in the vicinity of the curved surface end 77*b*** of the gas flow passage, as in the above-described embodiment, thereby obtaining the same effects.

Referring to another embodiment of the invention shown in FIG. 11A, a plurality of annular grooves **79*a*, 79*b* are formed on a periphery of the cover 78*a* and the straightening member 77*h* in a peripheral direction and are formed between the cover 78*a*. Also, referring to further embodiment, an electroconductive shield 79 is formed on each inner edge portions of the flow straightening member 77*d* so as to be in contact with the cover 78** in order to prevent a reduction in the interpole withstand voltage similarly as in other embodiments aforementioned.

What is claimed is:

1. A puffer type gas circuit breaker comprising:

at least one pair of a stationary contact and a movable contact which are adapted to be separated from each other;

a pressure producing section including a puffer cylinder and a puffer piston, said puffer cylinder being connected to said movable contact, and said puffer cylinder position being adapted to blow an arc extinguishing gas to an arc generated between sid contacts at the time of current breaking;

a cover surrounding said movable contact; and an insulated nozzle extending from said puffer cylinder and surrounding said cover and said stationary contact to form a flow passage through which compressed gas in said puffer cylinder is supplied from said puffer cylinder to the generated arc;, wherein said flow passage includes a first passage which extends in a direction substantially parallel to the direction of movement of said movable contact and which communicates with said puffer cylinder, a second passage which extends in a radial direction of said movable contact, and a bent passage extending between said first passage and said second passage, said bent passage having a gas flow sectional area greater than that of said first passage to form an expanded portion.

2. A puffer type gas circuit breaker according to claim 1, wherein said expanded portion of said flow passage is provided on an end side of said cover.

3. A puffer type gas circuit breaker according to claim 1, wherein said expanded portion of said flow passage is increased in capacity by recessing said insulated nozzle, at an inner surface thereof, in the radial direction.

4. A puffer type gas circuit breaker according to claim 1, wherein said expanded portion of said flow passage is increased in capacity by recessing said insulated nozzle, at an inner surface thereof, in the axial direction thereof on the stationary contact side.

5. A puffer type gas circuit breaker according to claim 1, wherein a flow straightening member is integrally formed on said insulated nozzle.

6. A puffer type gas circuit breaker according to claim 1, wherein a flow straightening member is integrally formed on said cover.

7. A puffer type gas circuit breaker according to claim 5 or 6, wherein an electroconductive shield is provided on said flow straightening member.

8. A puffer type gas circuit breaker according to claim 1, wherein a plurality of grooves are formed so as to extend circumferentially in at least one of an inner surface of said insulated nozzle and an outer surface of said cover.

9. A cover for covering a contact of a puffer type gas circuit breaker having a puffer cylinder with a plurality of gas supply holes at one end thereof and a puffer piston, said cover, adapted to be surrounded by an insulated nozzle, comprising:

a cylindrical main body; and a plurality of flow straightening members corresponding in number to that of said plurality of gas supply holes formed in said puffer cylinder, said plurality of flow straightening members being positioned so that each is between a pair of gas supply holes from said plurality of gas supply holes and each gas hole thereof is positioned between a respective pair of said flow straightening members, and said plurality of flow straightening members extending in an axial direction of said cylindrical main body along outer surface portions thereof;

wherein a chamber having a sectional area larger than a sectional area of space in a radial direction between said cover and said insulated nozzle is formed between said insulated nozzle and an end of said cover axially distanced therefrom when said insulated nozzle is surrounding said cover.

10. An insulated nozzle of a puffer type gas circuit breaker comprising:

a first insertion hole adapted to have inserted thereinto a movable contact, said first insertion hole extending axially from one end of a nozzle body along the center axis thereof;

a plurality of flow passages formed in said nozzle body so as to respectively communicate with a plurality of gas supply holes formed in a puffer cylinder and to extend substantially in the axial direction from the end away from said insertion hole; and an expanded chamber formed in said nozzle body having a sectional area larger than that of said plurality of flow passage;

wherein said plurality of flow passages communicate with said expanded chamber at their respective ends, said first insertion hole including a central aperture, and a second insertion hole through which a stationary contact is inserted is formed at the other end of said nozzle body.

11. A puffer type gas circuit breaker according to claim 1, wherein said first passage has a flow straightening member extending from said puffer cylinder.

12. A puffer type gas circuit breaker according to claim 11, wherein a gas flow sectional area of the first passage is substantially equal to a total gas flow sectional area of outlets of said puffer cylinder.

* * * * *